United States Patent [19]

Mandet et al.

[11] Patent Number: 4,465,432

[45] Date of Patent: Aug. 14, 1984

[54] SYSTEM FOR MOUNTING AND ATTACHING TURBINE AND COMPRESSOR PRISMATIC ROOTED BLADES AND MOUNTING PROCESS

[75] Inventors: Gérard M. F. Mandet, Epinay Sous Senart; Marc R. Marchi, Le Mee sur Seine, both of France

[73] Assignee: S.N.E.C.M.A., Paris, France

[21] Appl. No.: 448,405

[22] Filed: Dec. 9, 1982

[30] Foreign Application Priority Data

Dec. 9, 1981 [FR] France ..... 81 22982

[51] Int. Cl.[3] ..... F01D 5/32

[52] U.S. Cl. ..... 416/215; 416/220 R; 416/216; 416/219 R

[58] Field of Search ..... 416/215, 219 R, 220 R, 416/216, 217, 218

[56] References Cited

U.S. PATENT DOCUMENTS

| | | | |
|---|---|---|---|
| 843,237 | 2/1907 | Shepherd | 416/219 |
| 922,581 | 5/1909 | Hanzlik et al. | 416/218 |
| 974,496 | 11/1910 | Kemble | 416/220 |
| 1,601,402 | 9/1926 | Lorenzen | 416/218 |
| 2,405,146 | 8/1946 | Huber | 416/217 |

FOREIGN PATENT DOCUMENTS

| | | | |
|---|---|---|---|
| 733419 | 2/1943 | Fed. Rep. of Germany | 416/215 |
| 360073 | 3/1962 | Switzerland | 416/220 |
| 1358798 | 7/1974 | United Kingdom | 416/219 R |

*Primary Examiner*—Stephen Marcus
*Assistant Examiner*—John Kwon
*Attorney, Agent, or Firm*—Oblon, Fisher, Spivak, McClelland & Maier

[57] ABSTRACT

The system for mounting and attaching turbine and compressor prismatic rooted blades includes a mounting sector formed by the elimination of two circumferential flanges provided on the edges of the rim. The length of the sector is about three widths of the blade platform with a stop-blade having two diametrically opposite cut corners and a four-tooth stop-comb. The corresponding mounting procedure consists of turning the stop-blade between the vanes placed in the bottom of the sector and passing its platform above those of the two adjacent blades. The comb is introduced between the platforms of the three blades and the bottom of the sector.

10 Claims, 9 Drawing Figures

SYSTEM FOR MOUNTING AND ATTACHING TURBINE AND COMPRESSOR PRISMATIC ROOTED BLADES AND MOUNTING PROCESS

BACKGROUND OF THE INVENTION

The invention concerns a system for mounting and attaching prismatic rooted vanes in a turbine and compressor rotor, and a procedure for mounting said blades in the rotor disc. 2. Description of the Prior Art The use of prismatic rooted blades in turbine and compressor rotors allows simplification of the locking systems, since attachment of the blades is achieved by a single system placed last between two neighboring blades.

A disc intended to be filled with prismatic rooted blades has in its rim a circumferential groove into which the roots are introduced and then held.

Such a system is described for example in French Pat. No. 1,112,826. The groove provided in the disc has, from the outside towards the center of the disc, two peripheral flanges separated by a distance equal to the length of the platform and between which the platform is housed when the blade is in place, a narrow part corresponding to the length of the shank, and finally a part wider than the length of the blade root and higher than the distance separating the lower part of the blade root from the upper part of the platform. An insertion opening is provided in the groove and is obtained by removal of the narrow part over a length equal to the width of the platform.

The prismation rooted blade cooperating with the groove has a platform surmounting and projecting beyond a parallelepipedal shank and a root projecting beyond the ends of the stilt.

The mounting process consists of introducing the blade into the groove along the smallest dimension of the root, then bringing the blade into the opening and, after subjecting it to a 90° rotation, turning it towards the outside so as to bring the root to rest against the upper part of the opening. The blade is then slid circumferentially, with the platform being housed between the peripheral flanges of the groove. The same operation is repeated for each blade.

The last blade or blocking blade has at least one edge of its platform removed and replaced with a spline attached in slits made in the shank. The blocking blade is brought up between the blades placed on either side of the opening and is held between them by the turned-down spline.

This type of system, generally utilized for prismatic rooted blades, has the drawback of weakening the disc in the area of the insertion opening and results in poor fatigue resistance.

SUMMARY OF THE INVENTION

The object of the present invention is aimed at eliminating the insertion opening by an adjustment in the rim of the disc that causes weakening of the working part of the groove. Thus, according to the invention the system includes a mounting sector formed by the removal of two circumferential flanges provided on the edges of the rim, said sector being approximately equal in length to three times the width of the vane platform, a stop-vane having two diametrically opposite cut corners, and a stop device having at least two teeth the widths of which are equal to the distance between the shanks of two neighboring blades and shaped so that it can be placed between the bottom of the mounting sector and the underside of the platforms of three adjacent blades, including the stop-blades, occupying the mounting sector.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
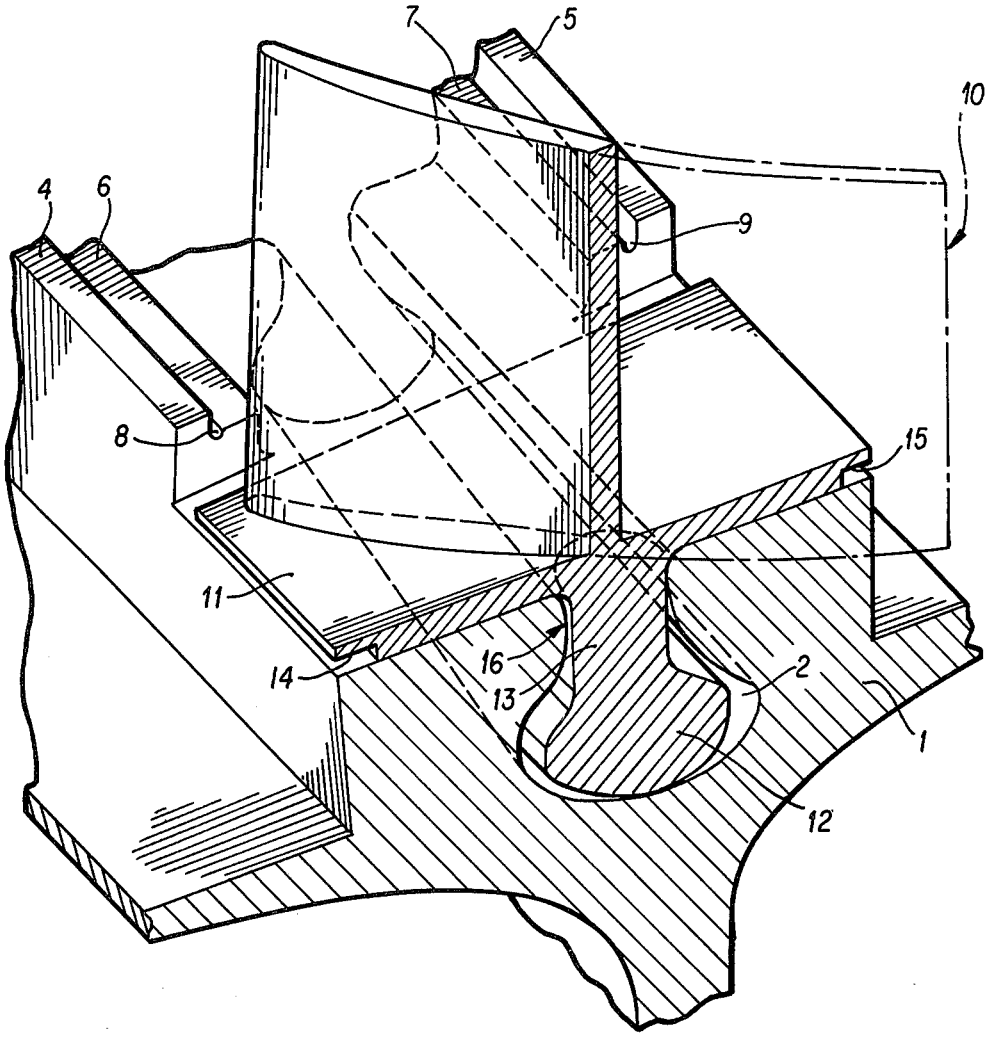
FIG. 1 shows in a perspective and partial cross-sectional view a blade housed in a rotor according to the invention.

FIG. 1 shows in perspective a portion of a rotor and turbine blade or compressor vane having fittings according to the present invention. The rotor 1 has in its radial plane a circumferential groove 2 in which are held by conventional means the roots 12 of the blades. The rim of the rotor has two flanges 4, 5 having formed therein towards the inside a break or recessed portion 6, 7. The faces of the breaks or recessed portions parallel to the surface of the rim may have circumferential notches 8, 9 the function of which will be discussed in greater detail hereinbelow.

Figure 4:
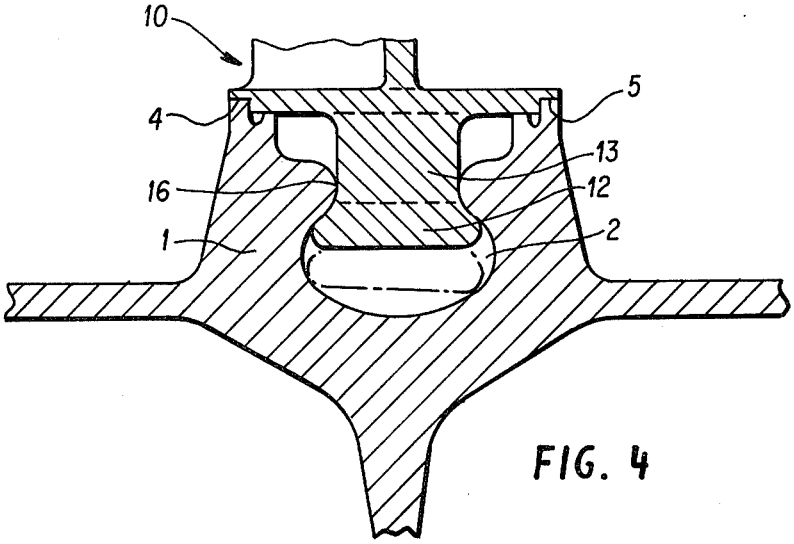
FIG. 4 is an axial cross-sectional view taken along IV—IV in FIG. 3.

The blade 10 consists of a blade mounted on an approximately rectangular platform 11, which is extended by a cylindrical shank 13 to the end of which is attached along the platform's plane of longitudinal symmetry the root 12 capable of cooperating with the groove. The upstream and downstream edges of the platform 11 have on their inside face breaks or recessed portions 14, 15 capable of cooperating with the breaks or recessed portions 6, 7 of the flanges 4, 5 of the rim (FIG. 4) when the blade is oriented towards its final position. The cylindrical shank 13 and the smallest dimension of the prismatic root 12 are provided in such a way as to permit their introduction into the constant-width opening 16 of the groove 2.

Figure 2:
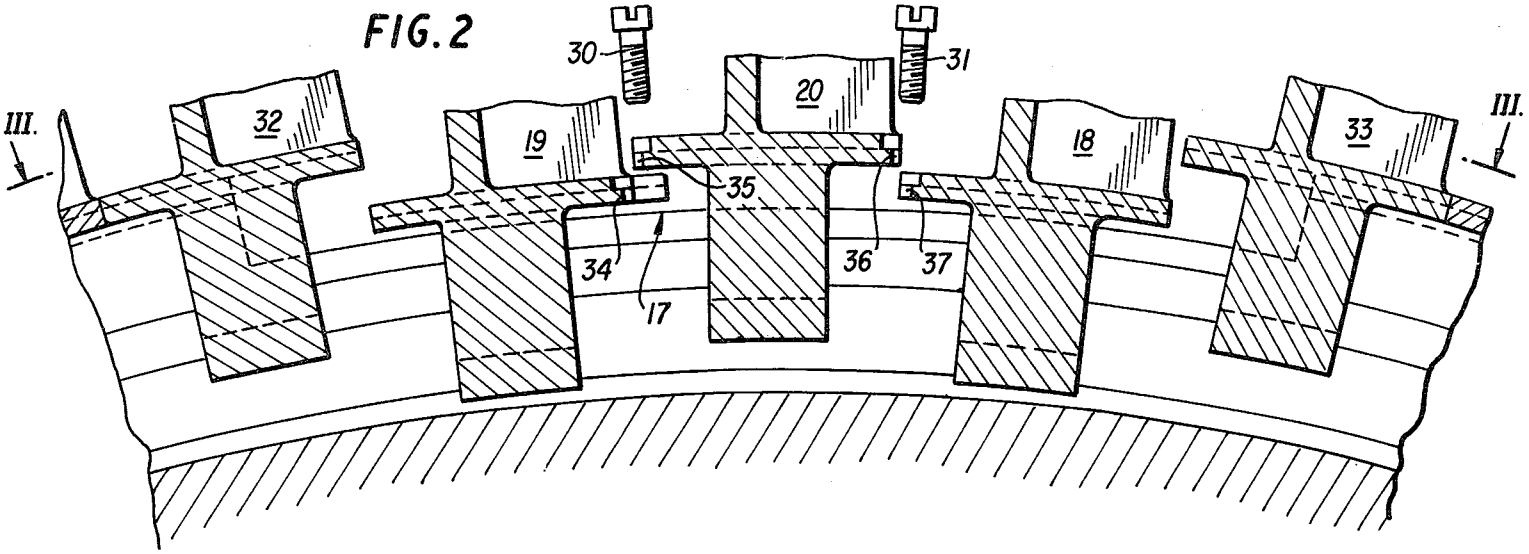
FIG. 2 is a radial cross-sectional view of part of the rotor's rim.

According to the characteristics of the invention, on the rim of the rotor a mounting sector 17 has been provided along the length of which the flanges 4, 5 have been eliminated (FIG. 2). The sector allows the introduction of the blade root and rotation of the vanes to orient the blades and the root into their final position (approximately 90° in relation to the position of introduction).

The blade are then drawn radially and moved circumferentially so as to place their platforms on the flanges of the rim. When the entire rim part bearring the flanges is equipped with blade, the mounting sector 17 is fitted with blade 18, 19, 20. The length of the sector 17 corresponds at least to the width of the platforms of the three blade 18, 19, 20.

The blades 18 and 19 may be similar to the blades already in place, with the exception of a half-hole formed in the edge of the platform, the usefulness of which will be seen from the following discussion. As for the stop-blade 20 (FIG. 3), it may have, in particular in case the chord from the blade to the footing should extend over the entire length of the platform's diagonal line, a platform having two diagonal cut off corners 21, 22. The distance separating the cut off corners 21, 22 is less than the shortest distance separating the blades of the blades 18 and 19 oriented and held in final position. With the blades directed approximately along a diagonal line of the platform, the cut off corners are preferably provided according to the other diagonal line.

In order to hold the platforms of the blades 18, 19, 20 at the same level as those of the blades 32, 33 resting on the flanges 4, 5 and to lock in position the stop-blade 20, a stop-comb 23 (FIG. 5) is provided, the width of which is equal to the length of the platforms 11 or to the width of the rim. Such has four teeth 24, 25, 26, 27 the widths of which are equal to the distance between the shank 13 of two neighboring blades and the interval between teeth being equal to the diameter of the shank 13. The bottom of the notches between the teeth has on the upper face of the comb 23 a milling 38 to allow adaptation to the fillet between blade platform 11 and shank 13. The comb 23 is placed between the platform 11 and the rim of the rotor in the rim sector 17. The thickness of the comb 23 is such that it fills the space limited by the lower face of the platforms 11 and the upper face of the rim forming the bottom of the sector 17. Two threaded holes 28, 29 provided in two of the teeth receive attachment devices such as screws 30 and 31 shown in FIG. 2. These screws are held in corresponding half-holes 34, 35, and 36, 37 in the edges facing the adjacent blades. In FIG. 2 and the corresponding top views, a double bore has been shown which allows the cylindrical head of the screws to be housed in the half-platforms without jutting above their surface.

The system for mounting and attaching prismatic rooted blades is thus composed of a sector 17 formed by the elimination of the flanges of the rotor rim extending over a length of at least three blades, of a stop-blades 20 having a platform 11 with diagonal cut off corners 21, 22, and of a stop-comb 23.

Figure 6:
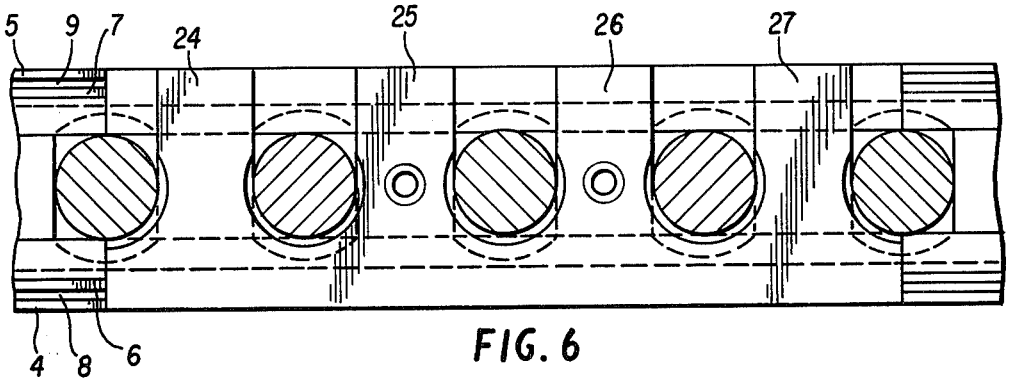
FIG. 6 is a view showing the stop-comb in place between the blades.
Figure 7:
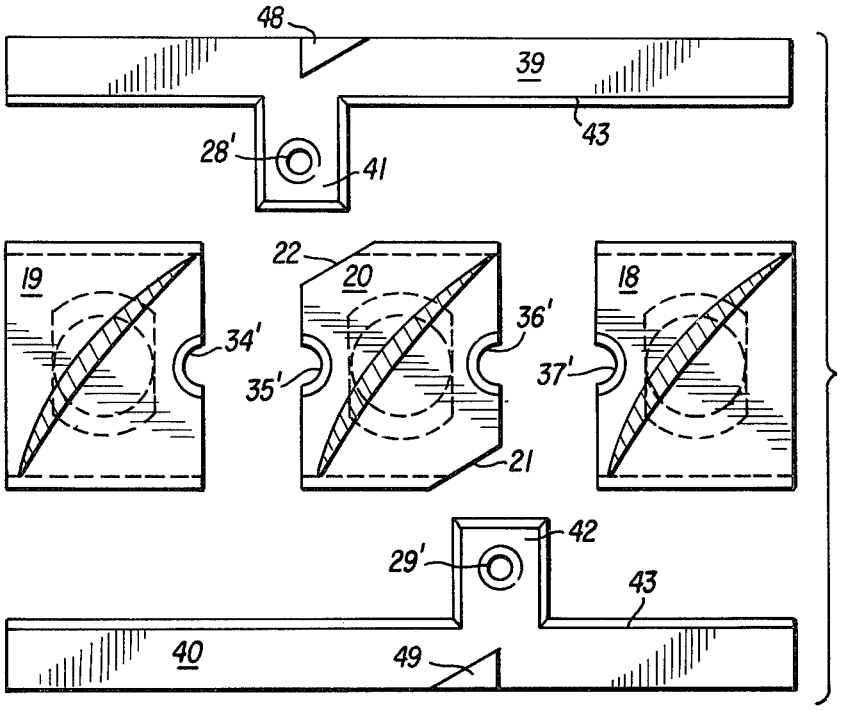
FIG. 7 is an exploded plane view of an alternate embodiment of the vane stop device.
Figure 8:
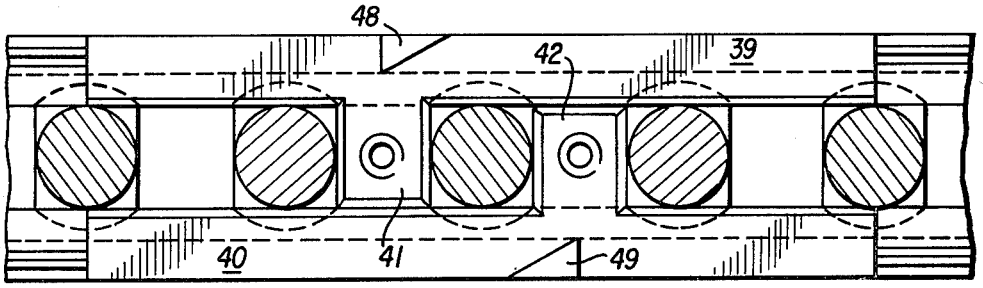
FIG. 8 is a plane view showing the stop device in FIG. 7 in place between the blades.

Shown in FIGS. 7 and 8 is a alternate embodiment of the top device allowing to hold the platforms of the blades 18, 19, 20 at the same level as those of the other blades housed in the circumferential groove. The stop device here consists of two small plates 39, 40 having a T shape mounted on either side of the circumferential groove in the sector 17. The vertical bar of each T forms a tooth, such as tooth 41 and tooth 42, the width of which is equal to the distance between the shanks of two neighboring blades. As in the embodiments shown in FIGS. 5 and 6, the thickness of these plates is such that it fills the space limited by the lower face of the platforms and the upper surface of the rim forming the bottom of the sector 17.

Each tooth 41, 42 has a threaded hole, 28', 29' respectively, receiving screws 30, 31 held in half-holes 34', 35' and 36', 37' in the lateral edges of two contiguous platforms, 19, 20 and 20, 18 respectively. The length of each tooth 41, 42 is such that it strikes the circumferential edge of the plate engaged in the other side of the groove. In a manner analagous to the embodiment described above, a champer 43 has been shown on the edge of the contour of the plate to allow adaptation to the connecting fillets between vane platform and shank.

An improvement aiming to perfect the continuity of the jet stream at the point of the cut off corners of the stop-platform 20 may include two alternate embodiments.

According to a first alternative embodiment making use of the stop device illustrated in FIGS. 7 and 8, the plates 39 and 40 have a corner-piece 48, 49 projecting outwardly respectively being housed in the space left free, respectively, between the cut corner 22 and the edge of the neighboring blade 19, and between the cut corner 21 and the edge of the neighboring blade 18.

Figure 5:
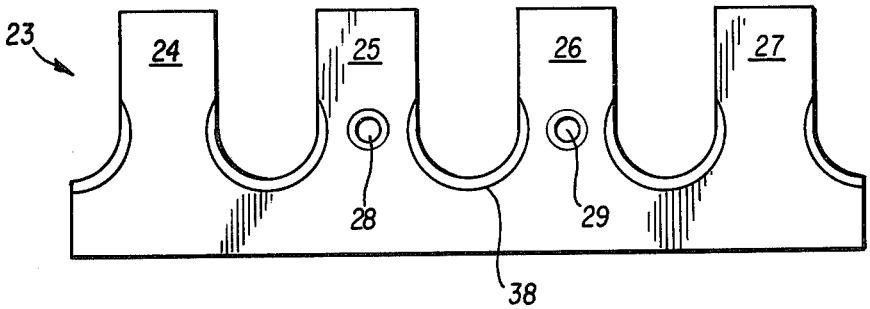
FIG. 5 is a plane view of a blade stop-comb.
Figure 9:
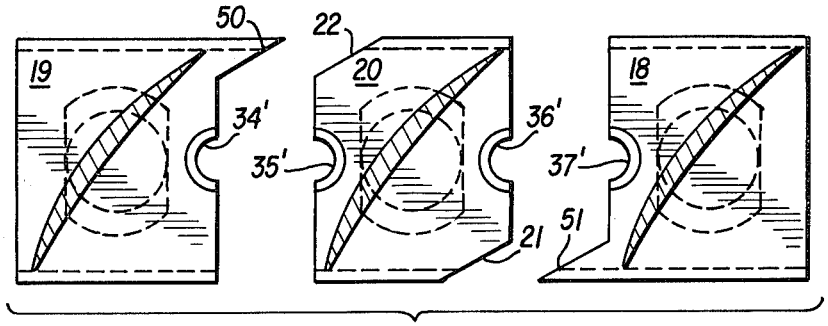
FIG. 9 is a top view, exploded, of the unit consisting of the platform of the stop-blade and those of the adjacent blades, according to an alternate embodiment.

Another embodiment, illustrated in FIG. 9, may be used either with the stop-comb illustrated in FIGS. 5 or 6 or with the stop device illustrated in FIGS. 7 and 8 (but of course in this case minus the projecting corner-pieces 48, 49). The contour of the blade 18 and 19 framing the stop-vane 20 consists of a triangular catch, 50, 51 respectively, which is housed in the corner portion left empty by the cut corner 22, 21 respectively of the stop-blade.

The procedure for mounting the blades on the rotor according to the invention includes the introduction of the vane stems into the circumferential groove of the rim in the area of the mounting sector, the root of one blade being introduced into the groove longitudinally, then turned by a 90° angle to bring the blade into its definitive position, and placing the root transversally in the groove. The blade is pulled radially, then slid circumferentially to bring the platform onto the flanges 4, 5 of the rim, the breaks or recessed portions 14 and 15 of the platform 11 cooperating with the breaks or recessed portions 6 and 7 of the flanges 4, 5 possibly with the interposition of a joint placed in the notches 8 and 9 to assure tight fitting. This operation is repeated until the part of the rim containing the flanges 4 and 5 is fully filled with blades. Then two blades 18 and 19 are introduced into the sector 17 and are oriented and pushed against the last two blades 32, 33 placed on the flanges. Between the two blades 18, 19 a stop-blade 20 is radially introduced which is oriented in the final direction. The blades 18 and 19 are pulled radially, and axially below the platforms of the three blades 18, 19, 20 the stop device is introduced and attached by two screws 30, 31 screwed into the threaded holes of the teeth in the stop device.

Figure 3:
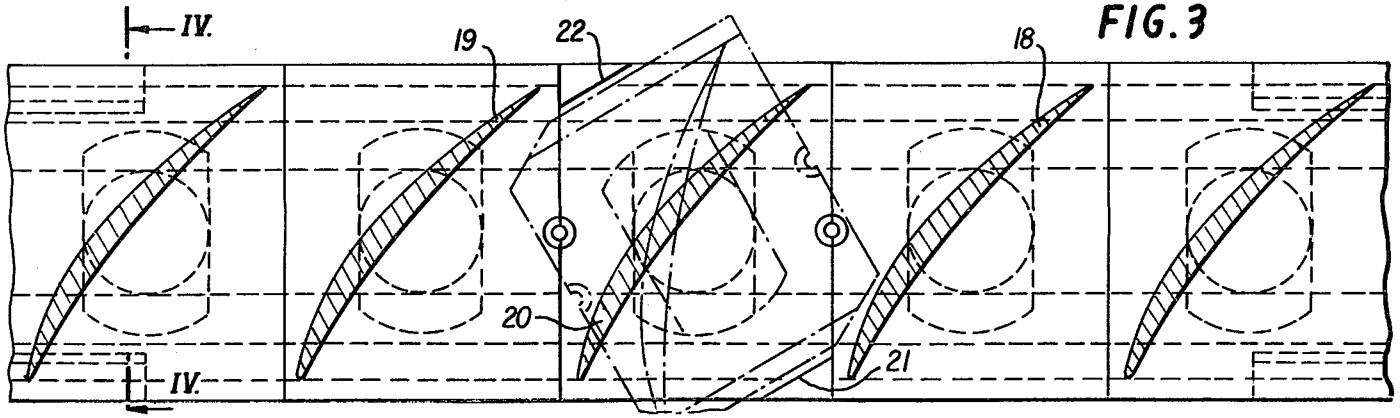
FIG. 3 is an expanded view taken along the circular section III—III in FIG. 2.

Introduction of the root of the stop-blade 20 is made possible by the cut corners 21, 22 of the platform. As the blade 20 is pulled radially, the platform can pass over the platforms of the blades 18 and 19 and turn between their air foil portions without being hindered by them and can take its place between the platforms of the two adjacent blades 18, 19. FIG. 3 shows in broken lines an intermediate position of the stop-blade 20 during placement by rotation.

As the preceding explanations and the figures have shown, the circumferential groove holding the blade roots maintains a constant width the entire length of the rim. In particular, the dimension of the narrow part 16 of the groove remains constant. The mounting sector 17, formed by elimination of the flanges of the rim, has no effect on the mechanical resistance of the circumferential groove or of the vane disc.

The system for mounting and attaching blades according to the invention eliminates one cause of turbine or compressor rotor fatigure without requiring increased weight or machining difficulties.

Obviously, numerous modifications and variations of the present invention are possible in light of the above teachings. It is therefore to be understood that within the scope of the appended claims, the invention may be practiced otherwise than as specifically described herein.

What is claimed as new and is intended to be secured by Letters Patent is:

1. A system for mounting and attaching prismatic rooted blades in a turbine and compressor rotor comprising:

a rotor rim having a circumferential groove formed therein and within which said blades are disposed wherein said blades each further comprise a airfoil portion, a rectangular platform attached to said blade, a cylindrical shank connected to said platform, and a root attached along the platform's plane of longitudinal symmetry to said shank for cooperative engagement with said groove;

a mounting sector having a length approximately equal to three times the width of said blade platform of each of said blades and which further comprise a first and second blade and a stop-blade disposed between said first and second blades and having a first and second cut corner diametrically opposite one another; and a stop device having at least two teeth, the widths of which are equal to the distance between the shanks of two neighboring vanes and which are shaped so as to be placed between a bottom portion of the mounting sector and an underside portion of the platforms of said first, second and stop-blades and for locking the position of said stop-blade.

2. A system according to claim 1, wherein said rim further comprises a first and second flange having a first and second break portion formed therein, respectively, and wherein said platforms of said blades each also further comprise a first and second break portion formed therein for cooperatively engaging with the break portions of said flanges.

3. A system according to claims 1 or 2, wherein the blade of the stop-blade lies in a plane approximately diagonal to the platform thereof and wherein said first and second cut corners are provided diagonally on said platform opposite the plane of said blade of said stop-vane.

4. A system according to claims 1 or 2, wherein said stop device further comprises a comb having a width equal to that of the rim and wherein said at least two teeth further comprises at least four teeth.

5. A system according to claim 1, wherein said stop device further comprises a first and second plate disposed on either side of said circumferential groove, each of said first and second plates having a tooth inserted between the stilts of the first or second blade and the stop-blade.

6. A system according to claims 1 or 2, wherein said teeth of said stop device have at least one hole formed therein and further comprise an attachment device mounted in each of said holes for securing said stop plate to said rim.

7. A system according to claim 6, wherein edge portions of the platforms of said first, second and stop-blades occupying the mounting sector have halfholes formed therein and further comprising an attachment device mounted in each of said holes for securing said stop plate to said rim.

8. A system according to claim 1, wherein the platforms of said first and second blades further comprise corner-shaped expansion members so that the edge of the contour of said platforms adjacent said stopblade fits the contour of a corresponding side of a stop-blade at the position corresponding to the first and second cut corners.

9. A sytem according to claim 5, wherein each of said first and second plates further comprise a cornerpiece shaped projection on an outer surface portion thereof occupying a space formed between a corresponding corner of the platform of the stop-blade and an adjacent edge of the neighboring platform of said first or second blade.

10. A system according to claim 1, further comprising a tightening joint wherein the brake portions formed in the first and second flanges of the rim each have a circumferential notch formed therein for receiving said tightening joint.

* * * * *